US008583016B2

(12) United States Patent
Goto

(10) Patent No.: US 8,583,016 B2
(45) Date of Patent: Nov. 12, 2013

(54) DEVELOPING DEVICE AND IMAGE FORMING APPARATUS

(75) Inventor: Takuya Goto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 350 days.

(21) Appl. No.: 12/929,489

(22) Filed: Jan. 28, 2011

(65) Prior Publication Data

US 2011/0188897 A1 Aug. 4, 2011

(30) Foreign Application Priority Data

Jan. 29, 2010 (JP) ..... 2010-018840

(51) Int. Cl.
*G03G 15/08* (2006.01)

(52) U.S. Cl.
USPC ..... 399/287; 399/149; 399/258; 399/264

(58) Field of Classification Search
USPC ..... 399/249, 252, 258, 260, 264, 265, 149, 399/187
See application file for complete search history.

(56) References Cited

U.S. PATENT DOCUMENTS

| | | | | | |
|---|---|---|---|---|---|
| 4,408,862 | A | * | 10/1983 | Takano et al. | 399/286 |
| 4,664,505 | A | * | 5/1987 | Itaya et al. | 399/358 |
| 4,930,438 | A | | 6/1990 | Demizu et al. | |
| 5,073,797 | A | * | 12/1991 | Ono et al. | 399/105 |
| 5,790,153 | A | * | 8/1998 | Takagi | 347/55 |
| 5,812,917 | A | | 9/1998 | Iwata et al. | |
| 2009/0035025 | A1 | * | 2/2009 | Ishii et al. | 399/266 |
| 2011/0135344 | A1 | * | 6/2011 | Ebe | 399/281 |

FOREIGN PATENT DOCUMENTS

| | | | | |
|---|---|---|---|---|
| JP | 2-287474 | | | 11/1990 |
| JP | 10-20662 | | | 1/1998 |
| JP | 2000-235302 | A | | 8/2000 |
| JP | 2001-051567 | A | | 2/2001 |
| JP | 2001-100516 | | | 4/2001 |
| JP | 2003-005528 | | | 1/2003 |
| JP | 2003005528 | A | * | 1/2003 |
| JP | 2003-345120 | | | 12/2003 |

* cited by examiner

*Primary Examiner* — David Gray
*Assistant Examiner* — Francis Gray
(74) *Attorney, Agent, or Firm* — Rabin & Berdo, P.C.

(57) ABSTRACT

A developing device includes a developer bearing body provided so as to face a latent image bearing body. The developer bearing body rotates to supply a developer to the latent image bearing body. A developer supplying member is provided so as to contact the developer bearing body. The developer supplying member rotates to supply a developer to the developer bearing body. A developer recovery member is provided so as to contact a surface of the developer bearing body that moves from a position facing the latent image bearing body to a position in contact with the developer supplying member by a rotation of the developer bearing body. The developer recovery member rotates to recover the developer from the developer bearing body. The developer recovery member is constituted by a brush roller.

26 Claims, 6 Drawing Sheets

COMPARISON EXAMPLE

DEVELOPING DEVICE AND IMAGE FORMING APPARATUS

BACKGROUND OF THE INVENTION

The present invention relates to a developing device and an image forming apparatus.

An electrophotographic image forming apparatus is configured to form an image through processes of charging, exposure, developing, transferring, fixing and cleaning. There are plural kinds of developing devices for use in the developing process. Among plural kinds of developing devices, a contact-type developing device using a nonmagnetic single-component toner is broadly used, since such a developing device is compact in size and low in cost.

The contact-type developing device using a nonmagnetic single-component toner (hereinafter, simply referred to as a contact-type developing device) includes a photosensitive drum as a latent image bearing body and a developing roller as a developer bearing body. The developing roller contacts the photosensitive drum, and is applied with a voltage to develop a latent image on the photosensitive drum using a toner as a developer. The contact-type developing device further includes a toner layer regulating blade that regulates a thickness of a toner layer formed on the developing roller, and a supply-and-recovery roller that recovers the toner (i.e., a residual toner) that has not used for development from the developing roller, and supplies the recovered toner to the developing roller.

Further, in order to reduce damage to the toner, there is proposed a contact-type developing device in which a brush roller is used as the supply-and-recovery roller (see, Japanese Laid-Open Patent Publication No. 2005-235302).

Generally, in order to ensure printing density, the supply-and-recovery roller is applied with a voltage so as to form an electric field for moving the toner from the supply-and-recovery roller toward the developing roller. Therefore, the supply-and-recovery roller recovers the residual toner from the developing roller only by means of friction between the residual toner and the supply-and-recovery roller, and therefore efficiency in recovering the residual toner is relatively low.

There has been an increasing demand for a technique for enhancing the efficiency in recovering the residual toner from the developing roller.

SUMMARY OF THE INVENTION

The present invention is intended to provide a developing device and an image forming apparatus capable of enhancing efficiency in recovering a residual toner from a developer bearing body.

According to an aspect of the present invention, there is provided a developing device including a developer bearing body provided so as to face a latent image bearing body. The developer bearing body rotates to supply a developer to the latent image bearing body. A developer supplying member is provided so as to contact the developer bearing body. The developer supplying member rotates to supply the developer to the developer bearing body. A developer recovery member is provided so as to contact a surface of the developer bearing body that moves from a position facing the latent image bearing body to a position in contact with the developer supplying member by a rotation of the developer bearing body. The developer recovery member rotates to recover the developer from the developer bearing body. The developer recovery member is constituted by a brush roller.

According to another aspect of the present invention, there is provided a developing device including a developer bearing body provided so as to face a latent image bearing body. The developer bearing body rotates to supply a developer to the latent image bearing body. A developer supplying member is provided so as to contact the developer bearing body. The developer supplying member rotates to supply the developer to the developer bearing body. A developer recovery member is provided so as to contact a surface of the developer bearing body that moves from a position facing the latent image bearing body to a position in contact with the developer supplying member by a rotation of the developer bearing body. The developer recovery member rotates to recover the developer from the developer bearing body. The developer supplying member and the developer recovery member are provided so as to contact each other.

With such a configuration, the developer can be efficiently recovered from the developer bearing body without causing damage to the developer.

The present invention also provides an image forming apparatus including the above described developing device.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings.

First Embodiment

An image forming apparatus having a developing device according to the first embodiment will be described.

[Image Forming Apparatus]

Figure 1:
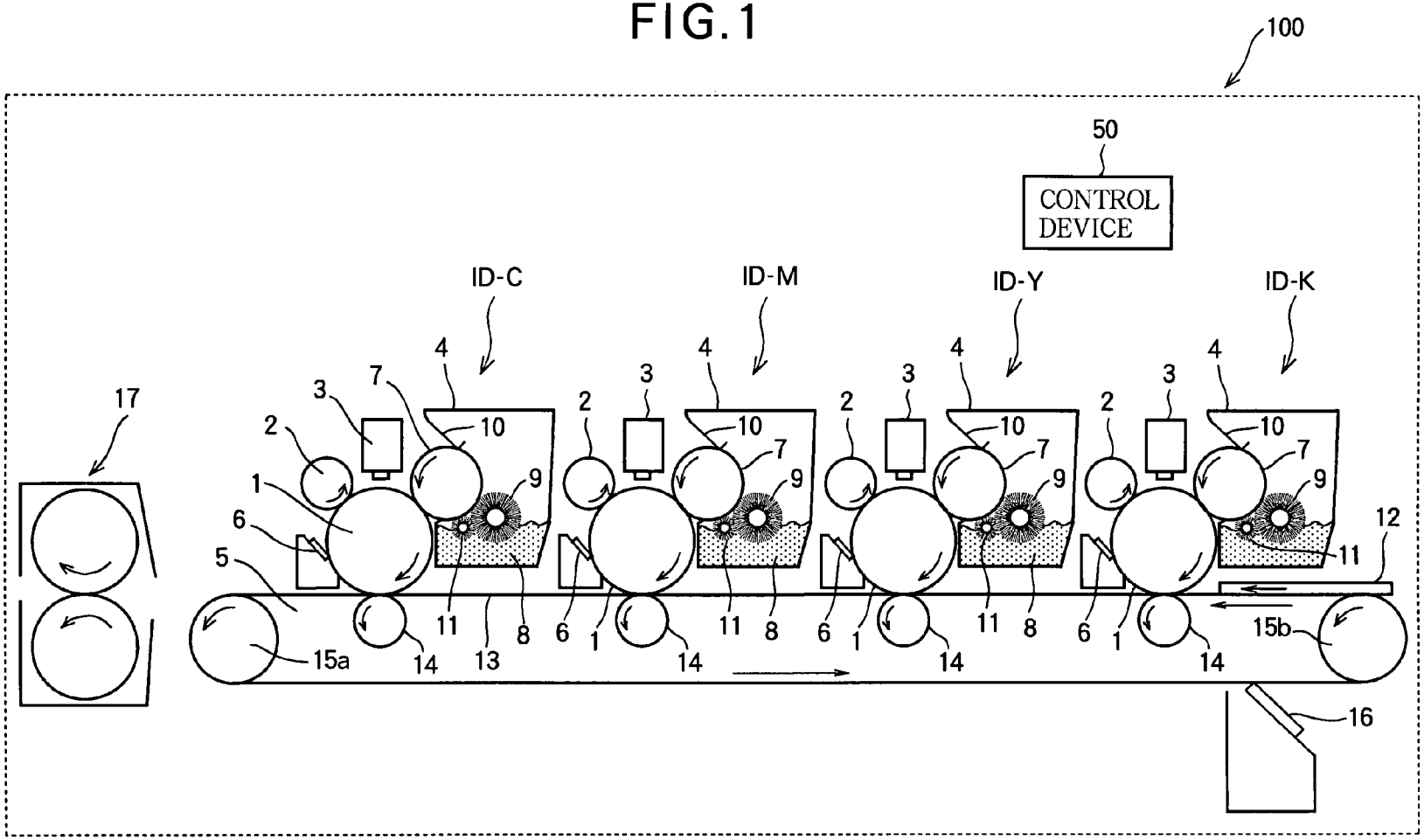
FIG. 1 is a schematic view showing a configuration of an image forming apparatus according to the first embodiment.

FIG. 1 is a schematic view showing a configuration of an image forming apparatus 100 having a developing device 4 according to the first embodiment of the present invention.

As shown in FIG. 1, the image forming apparatus 100 includes four image forming portions ID-K, ID-Y, ID-M and ID-C corresponding to four colors (black, yellow, magenta and cyan) arranged along a feeding path of a printing medium 12 in this order from the right to the left in FIG. 1. The image forming apparatus 100 further includes a fixing device 17, a control device (i.e., a control unit) 50, an image reading unit, a medium feeding unit, a medium ejection unit and the like. The image reading unit, the medium feeding unit and the medium ejection unit are not shown in FIG. 1.

The image forming portions ID-K, ID-Y, ID-M and ID-C have the same configurations except toners, and therefore a configuration of the image forming portion ID-C will be described.

The image forming portion ID-C includes a photosensitive drum 1, a charging roller (as a charging device) 2, an exposure device 3, a developing device 4, a transferring device 5, a cleaning blade (as a cleaning member) 6 and the like.

The charging roller 2 is provided so as to contact the photosensitive drum 1, and uniformly charges a surface of the photosensitive drum 1.

The exposure device 3 emits light to expose the surface of the photosensitive drum 1 according to image signal outputted from a printing control section 31 (see, FIG. 3) so as to form a latent image on the surface of the photosensitive drum 1.

The developing device 4 stores a toner 8 as a developer, and causes the charged toner 8 to adhere to the latent image on the surface of the photosensitive drum 1. The developing device 4 includes a developing roller (as a developer bearing body) 7, a supplying roller (as a developer supplying member) 9, a toner layer regulating blade (as a developer layer regulating member) 10, and a recovery roller (as a developer recovery member) 11.

The developing roller 7 is provided so as to contact the surface of the photosensitive drum 1. The developing roller 7 rotates to supply the toner 8 to the photosensitive drum 1. The toner supplying roller 9 charges the toner 8, and supplies the charged toner 8 to the developing roller 7. The toner layer regulating blade 10 is pressed against the surface of the developing roller 7. The toner layer regulating blade 10 forms a layer of the toner 8 (supplied by the supplying roller 9) on the surface of the developing roller 7. The recovery roller 11 recovers the residual toner 8 (that has not been used for development and has been carried back into the developing device 4) from the developing roller 7. A more detailed description of the developing device 4 will be made later.

The cleaning blade 6 is provided so as to contact the surface of the photosensitive drum 1. The cleaning blade 6 scrapes off the toner 8 remaining on the surface of the photosensitive drum 1 after transferring of the toner image.

The transferring device 5 is configured to transfer the toner 8 adhering to the latent image on the photosensitive drum 1 to the printing medium 12 such as a printing sheet. The transferring device 5 includes a transferring belt 13, transferring rollers 14, driving rollers 15*a* and 15*b*, a cleaning blade 16 and the like. The transferring rollers 14 are respectively provided so as to face the photosensitive drums 1 of the image forming portions ID-K, ID-Y, ID-M and ID-C. The transferring rollers 14 are applied with predetermined voltages so as to transfer the latent images formed on the photosensitive drums 1 to the printing medium 12. The driving rollers 15*a* and 15*b* rotate to move the transferring belt 13 in a direction shown by an arrow in FIG. 1. The cleaning blade 16 is provided so as to contact the transferring belt 13 at a lower downstream end in the moving direction of the transferring belt 13, and cleans the surface of the transferring belt 13.

The fixing device 17 is provided on a downstream side (i.e., the left side in FIG. 1) of the image forming portion ID-C along the feeding path of the printing medium 12. The fixing device 17 is configured to fix a toner image to the printing medium 12.

The control device 50 controls an entire operation of the image forming apparatus 100. The control device 50 outputs control signals or the like to respective functioning parts, applies voltages to the respective rollers. A more detailed description of the control device 50 will be made later.

[Toner]

The toner 8 is a negatively chargeable pulverization (grinded) toner. The toner 8 contains polyester as binder resin, carbon black, copper phthalocyanine pigment (C. I. Pigment Blue 15), quinacridone pigment (C. I. Pigment Red 122), Isoindoline pigment (C. I. Pigment Yellow 185) as coloring agent, and the like. Mean volume diameter of the toner 8 is 5.8 μm.

The toner 8 is added with external additives for controlling fluidity and chargeability. The external additives are, for example, titanium oxide, alumina, silica or the like. Silica is subjected to silicone oil treatment, disilazane treatment or the like. Generally, external additives contain particles whose primary particle diameters are respectively 7 nm, 12 nm, 14 nm, 21 nm and 40 nm. The external additives used in this embodiment contain particles with different primary particle diameters selected among the above described diameters. The particles with different diameters are mixed at a certain ratio, and are externally added to the toner using a Turbula mixer, Henschel mixer or the like.

[Developing Device]

Figure 2:
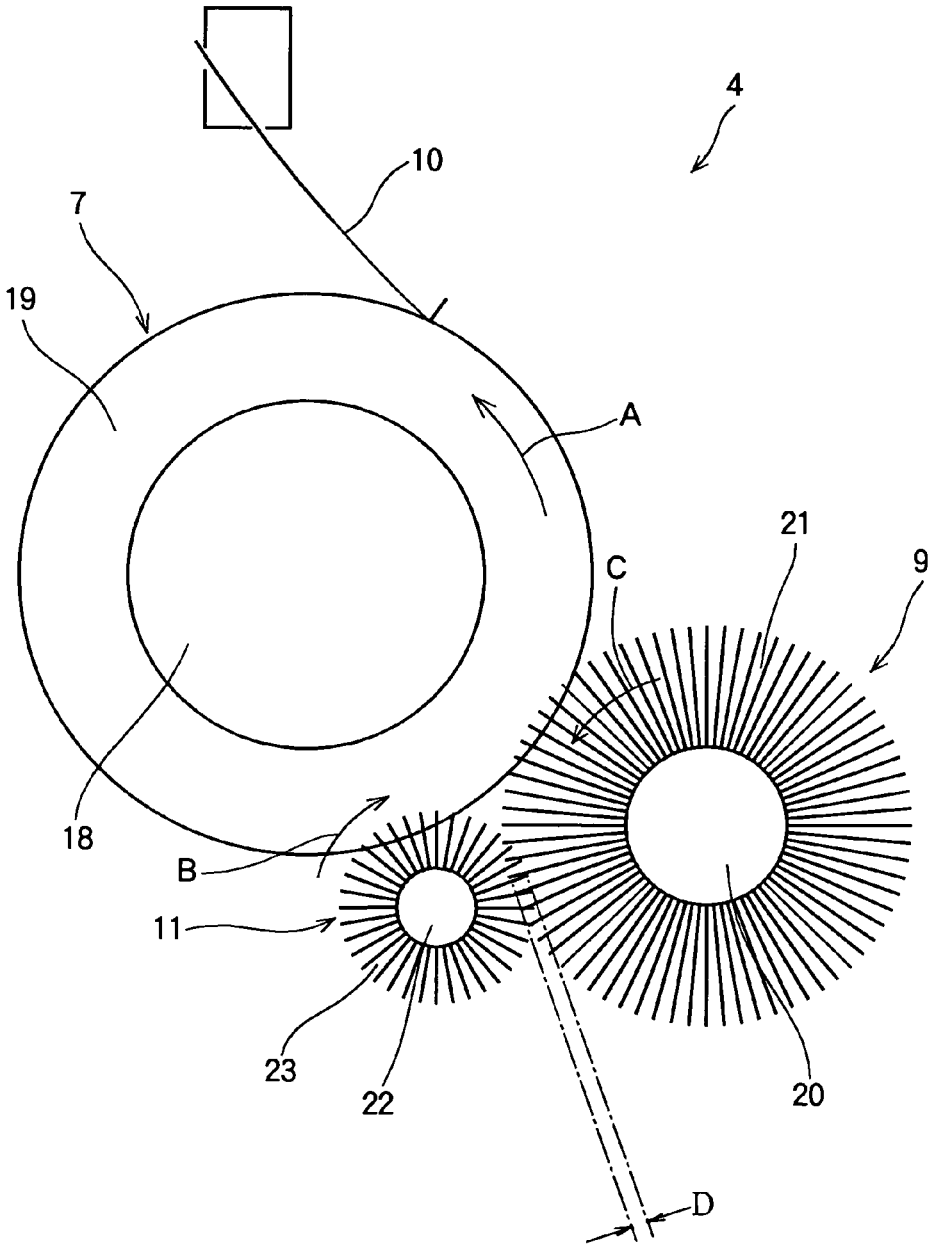
FIG. 2 is a schematic view showing a developing device of the image forming apparatus according to the first embodiment.

FIG. 2 is a schematic view showing a configuration of the developing device 4. As described above, the developing device 4 includes the developing roller 7, the supplying roller 9, the toner layer regulating blade 10 and the recovery roller 11.

The toner layer regulating blade 10 is formed of metal having resiliency. For example, the toner layer regulating blade 10 is formed of stainless steel such as SUS (Steel Use Stainless) 304, and has a thickness of 0.08 mm. The toner layer regulating blade 10 is formed to have an L-shape. A bent portion of the toner layer regulating blade 10 is pressed against the surface of the developing roller 7.

The developing roller 7 is formed of a metal shaft 18 and a resilient body 19. The resilient body 19 is formed around a circumferential surface of the metal shaft 18. The metal shaft 18 has an outer diameter of 12 mm. The resilient body 19 has a thickness of 4 mm, and is formed of semiconductive silicone rubber with rubber hardness of 60° (Asker-C). The resilient body 19 has a surface layer subjected to a treatment for adjusting friction coefficient, surface roughness or chargeability.

The supplying roller 9 is constituted by a brush roller, and includes a metal shaft 20 and brush bristles 21. A circumferential surface of the metal shaft 20 is covered with the brush bristles 21. The metal shaft 20 has an outer diameter of 10 mm. The brush roller is formed by winding a pile woven fabric having a ribbon shape around the metal shaft 20 in a spiral form. The brush bristles 21 are made of nylon. Nylon has the same polarity as the toner 8, and is employed as the brush bristles 21 in order to negatively charge the polyester (i.e., the binder resin) of the toner 8 having negative chargeability. The brush bristles 21 have a length of 3 mm, and have fineness of 6 decitex. The supplying roller 9 has an electric resistance of 8 log Ω.

The recovery roller 11 is constituted by a brush roller, and includes a metal shaft 22 and brush bristles 23. A circumferential surface of the metal shaft 22 is covered with the brush bristles 23. The metal shaft 22 has an outer diameter of 6 mm.

The brush roller is formed by winding a pile woven fabric having a ribbon shape around the metal shaft 22 in a spiral form. The brush bristles 23 are made of nylon. The brush bristles 23 have a length of 3 mm, and have fineness of 6 decitex. The recovery roller 11 has an electric resistance of 8 log Ω.

The recovery roller 11 is provided so as to contact the developing roller 7. The supplying roller 9 is provided so as to contact the developing roller 7. The recovery roller 11 and the supplying roller 9 contact each other.

[Control Device]

Figure 3:
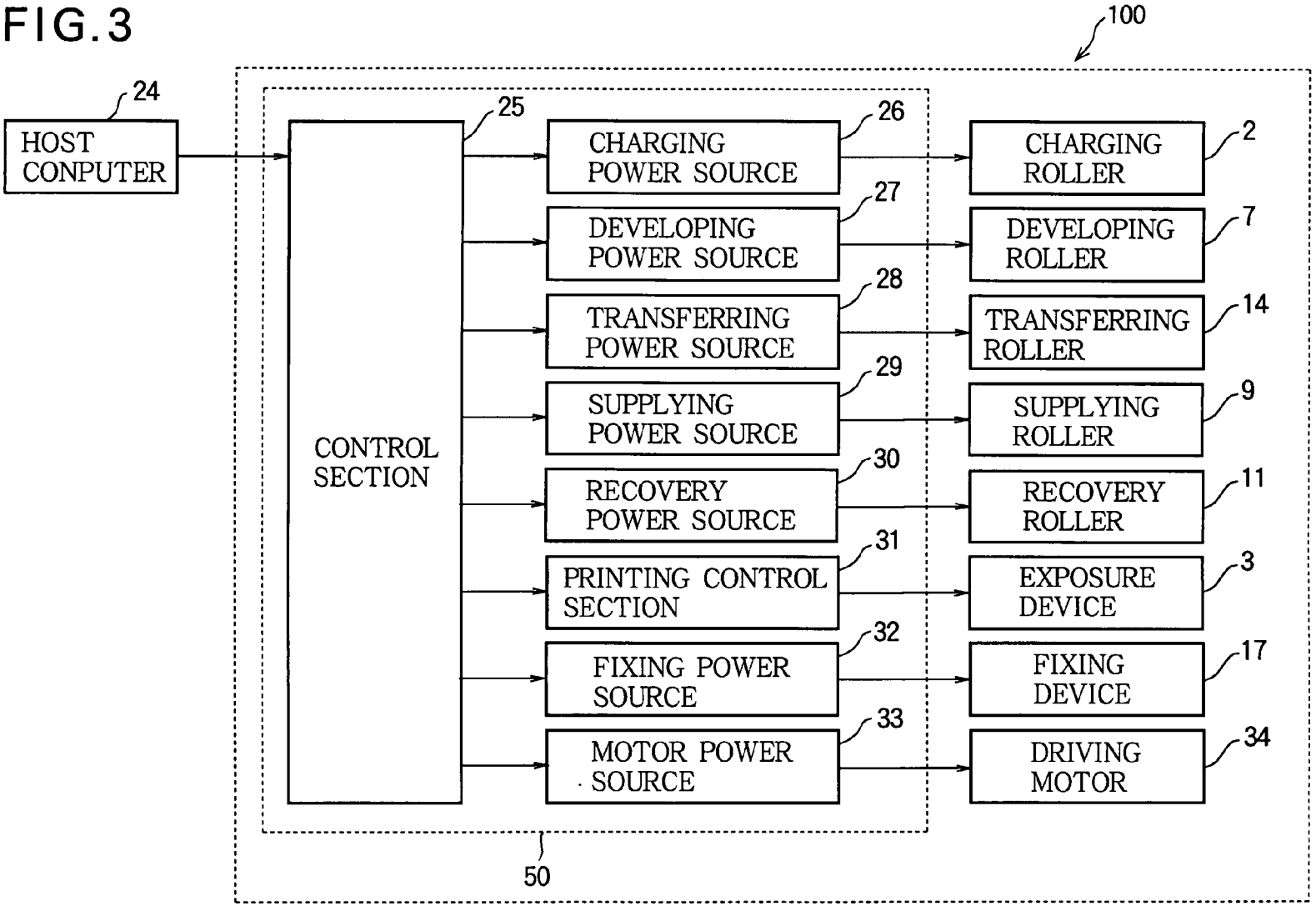
FIG. 3 is a control block diagram showing a control system of the image forming apparatus according to the first embodiment.

FIG. 3 is a control block diagram showing a control block of the control device 50. The control device 50 includes a control section 25, a charging power source 26, a developing power source 27, a transferring power source 28, a supplying power source 29, a recovery power source 30, a printing control section 31, a fixing power source 32 and a motor control section 33.

The control section 25 is electrically connected with the charging power source 26, the developing power source 27, the transferring power source 28, the supplying power source 29, the recovery power source 30, the printing control section 31, the fixing power source 32 and the motor control section 33, and performs overall control of these functioning parts. The control section 25 is electrically connected with a host computer 24 outside the image forming apparatus 100. The control section 25 receives the printing data or the like from the host computer 24, and outputs various command signals to the respective functioning parts for an image forming operation.

Based on the command signals from the control section 25, the charging power source 26 applies a voltage to the charging rollers 2, the developing power source 27 applies a voltage to the developing rollers 7, the transferring power source 28 applies a voltage to the transferring rollers 14, the supplying power source 29 applies a voltage to the supplying rollers 9 and the recovery power source 30 applies a voltage to the recovery rollers 11.

The developing roller 7 and the recovery roller 11 are applied with different voltages so as to apply electrostatic force to the toner 8 in a direction from the developing roller 7 to the recovery roller 11. To be more specific, if the toner 8 has negative chargeability, the recovery roller 11 is applied with a higher voltage than a voltage applied to the developing roller 7. If the toner 8 has positive chargeability, the recovery roller 11 is applied with a lower voltage than a voltage applied to the developing roller 7.

In this example, the toner 8 has a negative chargeability. The developing roller 7 is applied with a voltage of −200V, and the recovery roller 11 is applied with a voltage of −100V. Further, the charging roller 2 is applied with a voltage of −1050V, and the supplying roller 9 is applied with a voltage of −330V.

The printing control section 31 outputs image signals of the respective colors to the exposure devices 3 of the image forming units ID-K, ID-Y, ID-M and ID-C so as to control the exposure devices 3.

The fixing control section 32 causes a heater (not shown) of the fixing device 17 to be heated, based on the command signal from the control section 25.

The motor control section 33 drives a driving motor 34 based on the command signal from the control section 25 so as to rotate the photosensitive drums 1, the charging rollers 2, the developing rollers 7, the supplying roller 9, the recovery rollers 11, the driving rollers 15*a* and 15*b*, and rollers of the fixing device 17.

[Operation of Image Forming Apparatus]

Next, an operation of the image forming apparatus 100 will be described with reference to FIGS. 1 to 3.

When the control section 25 receives a printing data from the host computer 24, the control section 25 sends command signals to the motor control section 33 to drive the driving motor 34 so as to rotate the photosensitive drums 1, the charging rollers 2, the developing rollers 7, the supplying rollers 9, the recovery rollers 11, the driving rollers 15*a* and 15*b*, the rollers of the fixing device 17 at constant circumferential speeds in respective directions shown by arrows in FIG. 1.

Further, the control section 25 sends command signal to the developing power source 27 to apply a direct voltage (−200V) to the developing rollers 7. The control section 25 sends command signal to the transferring power source 28 to apply a direct voltage to the transferring rollers 14. The control section 25 sends command signal to the supplying power source 29 to apply a direct voltage (−330V) to the supplying rollers 9. The control section 25 sends command signal to the recovery power source 30 to apply a direct voltage (−100V) to the recovery rollers 11. The control section 25 sends command signal to the charging power source 26 to apply a direct voltage (−1050V) to the charging rollers 2.

In a charging process, the charging roller 2 (applied with the voltage) uniformly charges the surface of the photosensitive drum 1. In this regard, a surface potential of the photosensitive drum 1 is, for example, approximately −550V.

In an exposure process, the control section 25 sends command signal to the printing control section 31 to output image signal to the exposure device 3 according to the printing data. The exposure device 3 emits light to expose the surface of the photosensitive drum 1 according to the image signal so as to form a latent image on the photosensitive drum 1.

In a developing process, the supplying roller 9 (applied with the voltage) rotates, and supplies the toner 8 in the developing device 4 to the developing roller 7. In this regard, the developing roller 7 and the supplying roller 9 rotate in the same directions as shown in FIG. 2. Further, according to the control by the control section 25, a circumferential speed of the supplying roller 9 is 0.6 times the circumferential speed of the developing roller 7.

The developing roller 7 carries the toner 8 adhering to the surface thereof in a rotating direction shown by an arrow A in FIG. 2. The toner layer regulating blade 10 is disposed at a downstream side with respect to the supplying roller 9 along the rotating direction A of the developing roller 7, and forms a thin toner layer on the surface of the developing roller 7. Further, the toner layer regulating blade 10 is applied with a direct voltage (−330V) by a not shown high voltage power source. Further, the toner layer regulating blade 10 is pressed against the developing roller 7 with a pressure of 0.8 N/cm$^2$.

The developing roller 7 carries the toner 8 having passed the toner layer regulating blade 10 to a further downstream side along the rotating direction A of the developing roller 7, and causes the toner 8 to adhere to the latent image on the photosensitive drum 1. A bias voltage is applied between an electrically-conductive supporting body of the photosensitive drum 1 and the developing roller 7 (applied with the voltage of −200V). Therefore, lines of electric forces are generated between the developing roller 7 and the photosensitive drum 1 due to the latent image on the photosensitive drum 1. The charged toner 8 on the surface of the developing roller 7 adheres to the latent image on the photosensitive drum 1 by means of electrostatic force, so that a toner image is formed. The toner 8 on the developing roller 7 facing a non-latent-image area on the photosensitive drum 1 does not move to the photosensitive drum 1, but remains on the developing roller 7.

The developing roller 7 carries such a residual toner 8 to a further downstream side along the rotating direction A of the developing roller 7, and carries the residual toner 8 back into the developing device 4. The recovery roller 11 causes the residual toner 8 to be released from the developing roller 7 by means of electrostatic force and to adhere to the recovery roller 11. In other words, the recovery roller 11 recovers the residual toner 8 from the developing roller 7. A more detailed description of the operation of the recovery roller 11 will be made later.

In a transferring process, the transferring belt 13 is moved in a direction shown by an arrow in FIG. 1 by the rotation of the driving rollers 15*a* and 15*b*. The transferring belt 13 receives the printing medium 12 supplied from a not shown medium feeding cassette (i.e., the medium feeding unit), and feeds the printing medium 12 through between the photosensitive drums 1 and the transfer rollers 14.

The transfer roller 14 provided so as to face the photosensitive drum 1 is applied with a high voltage by a not shown high voltage power source. The transferring device 5 transfers the toner 8 (adhering to the latent image on the photosensitive drum 1) to the printing medium 12 fed through between the photosensitive drum 1 and the transferring roller 14. The transfer belt 13 further feeds the printing medium 12 to the fixing device 17 provided on the downstream side along the feeding path of the printing medium 12.

A slight amount of the toner 8 may remain on the photosensitive drum 1 after the transferring of the toner 8 to the printing medium 12. Such a toner 8 is removed by the cleaning blade 6, so that the photosensitive drum 1 is repeatedly used.

The above described charging process, exposure process, developing process, transferring process are respectively performed for the respective image forming portions ID-K, ID-Y, ID-M and ID-C.

In a fixing process, the fixing device 17 applies heat and pressure to the toner 8 on the printing medium 12 so that the toner 8 melts and permeates fabric of the printing medium 12, so that the toner 8 is fixed to the printing medium 12. After the fixing process, the printing medium 12 is ejected to the outside of the image forming apparatus 100 by the medium ejection unit (not shown).

[Recovery of Residual Toner]

Next, a recovery of the toner 8 from the developing roller 7 by the recovery roller 11 will be described in detail.

The recovery roller 11 is applied with the direct voltage of −100V by the recovery power source 30 as described above, and rotates in a direction shown by an arrow B (FIG. 2) about a rotation axis defined by the shaft 22. The rotating direction B of the recovery roller is opposite to the rotating direction A of the developing roller 7. According to the control by the control section 25, a circumferential speed of the recovery roller 11 is 1.2 times the circumferential speed of the developing roller 7.

Since the recovery roller 11 and the developing roller 7 rotate in mutually opposite directions, the circumferential surfaces of the recovery roller 11 and the developing roller 7 move in the same direction at a contact portion therebetween. In this regard, if the circumferential speeds of the recovery roller 11 and the developing roller 7 are the same as each other, a difference in moving speeds of the circumferential surfaces of the recovery roller 11 and the developing roller 7 at the contact portion becomes 0 (zero), so that efficiency in recovering the residual toner 8 may decrease. For this reason, it is preferable to increase the circumferential speed of the recovery roller 11, as compared with the circumferential speed of the developing roller 7.

The residual toner 8 on the developing roller 7 that has been carried back into the developing device 4 is negatively charged due to friction with the supplying roller 9 and the developing roller 7. Therefore, at a contact portion between the recovery roller 11 and the developing roller 7, the residual toner 8 moves from the developing roller 7 to the recovery roller 11 by means of electrostatic force, i.e., force due to electric field. In other words, the residual toner 8 is recovered by the recovery roller 11 by means of electrostatic force.

The recovery roller 11 carries the recovered toner 8 to a downstream side in the rotating direction B of the recovery roller 11, so that the toner 8 reaches a contact portion between the recovery roller 11 and the supplying roller 9.

According to the control by the control section 25, the circumferential speed of the recovery roller 11 is 2.0 times the circumferential speed of the supplying roller 9. The brush bristles 23 of the supplying roller 9 flip the toner 8 adhering to the brush bristles 21 of the recovery roller 11 so that the toner 8 is released from the recovery roller 11.

As the developing roller 7 rotates, the surface of the developing roller 7 from which the toner 8 is recovered contacts the supplying roller 9, and is supplied with the toner 8.

Comparison Example

Figure 4:
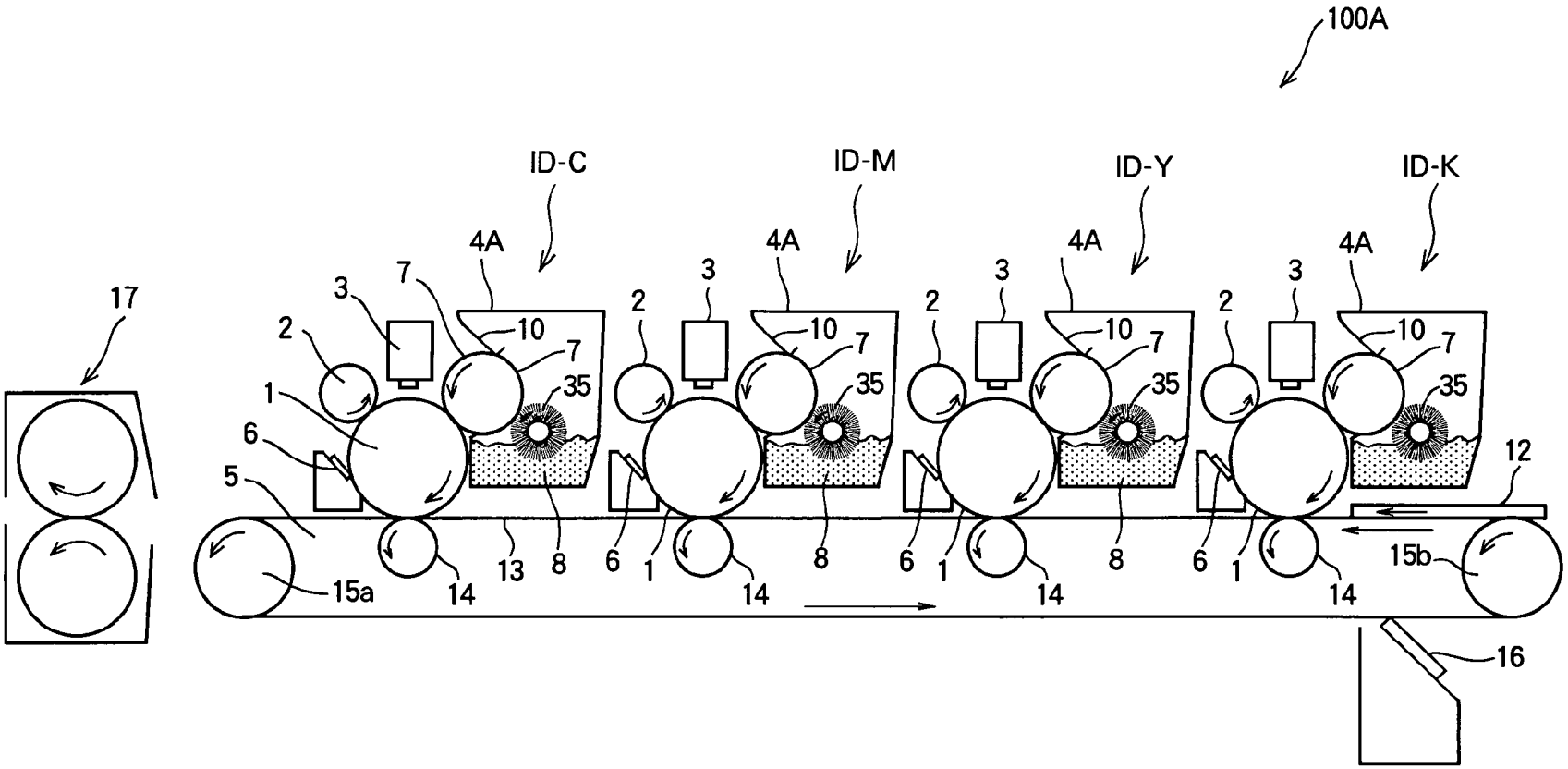
FIG. 4 is a schematic view showing a configuration of an image forming apparatus of a comparison example.

FIG. 4 shows an image forming apparatus 100A having a developing device 4A for contrast with the image forming apparatus 100 having the developing device 4. The image forming apparatus 100A having the developing device 4A of the comparison example is different from the image forming apparatus 100 having the developing device 4 in that the developing device 4A has no recovery roller 11 and instead has a supply-and-recovery roller 35. The supply-and-recovery roller 35 is configured to supply the toner 8 in the developing device 4 to the developing roller 7, and to recover the residual toner 8 from the developing roller 7. Other configurations of the image forming apparatus 100A of the comparison example are the same as those of the image forming apparatus 100 of the first embodiment of the present invention.

As shown in FIG. 4, the developing device 4A causes the charged toner 8 to adhere to the latent image on the surface of the photosensitive drum 1. The developing device 4A stores the toner 8, and includes the developing roller 7, the supply-and-recovery roller 35 and the toner layer regulating blade 10. The developing roller 7 rotates in contact with the photosensitive drum 1 so as to supply the toner 8 to the photosensitive drum 1. The supply-and-recovery roller 35 charges the toner 8 and supplies the toner 8 to the developing roller 7. The toner layer regulating blade 10 is pressed against the surface of the developing roller 7, and forms a layer of the toner 8 (supplied by the supply-and-recovery roller 35) on the developing roller 7. The supply-and-recovery roller 35 recovers the residual toner 8 (that has not been used for development but has been carried back into the developing device 4) from the developing roller 7 by means of frictional force.

Here, in order to obtain a sufficient image density, it is necessary to apply a voltage (i.e., a supplying voltage) to the supply-and-recovery roller 35 in a direction in which the charged toner 8 moves from the supply-and-recovery roller 35 toward the developing roller 7. Further, charging amount of the residual toner 8 on the developing roller 7 (that has not been used for development but has been carried back into the developing device 4) is larger than that of the toner 8 which is newly supplied to the developing roller 7 by the supply-and-recovery roller 35. Therefore, the above described supplying voltage makes it difficult for the supply-and-recovery roller 35 to recover the residual toner 8 from the developing roller 7.

Further, the charging amount of the residual toner 8 on the developing roller 7 is larger than that of the toner 8 newly supplied to the developing roller 7 by the supply-and-recovery roller 35 as described above. Therefore, in the developing process, the toner layer formed on the developing roller 7 by the toner layer regulating blade 10 may be unevenly charged. Such an uneven charging may result in density unevenness that may be viewed as ghost in the case where, for example, a halftone image is printed.

[Evaluation Test]

Next, a description will be made of a evaluation test using the image forming apparatus 100 having the developing device 4 of the first embodiment of the present invention, and the image forming apparatus 100A having the developing device 4A of the comparison example. In the evaluation test, a printing pattern with which ghost may easily occur is used.

Figure 5:
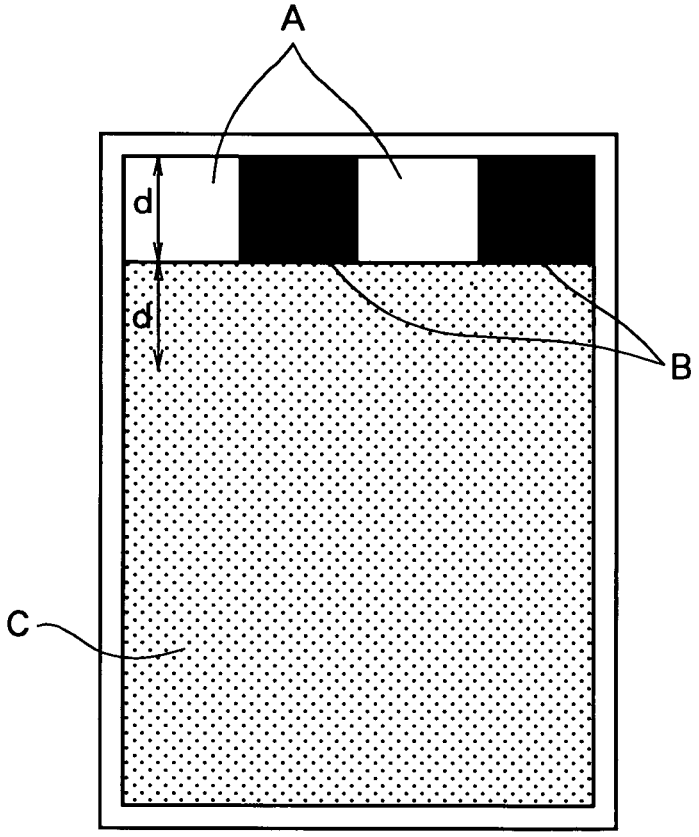
FIG. 5 is a printing pattern used in an evaluation test.
Figure 6:
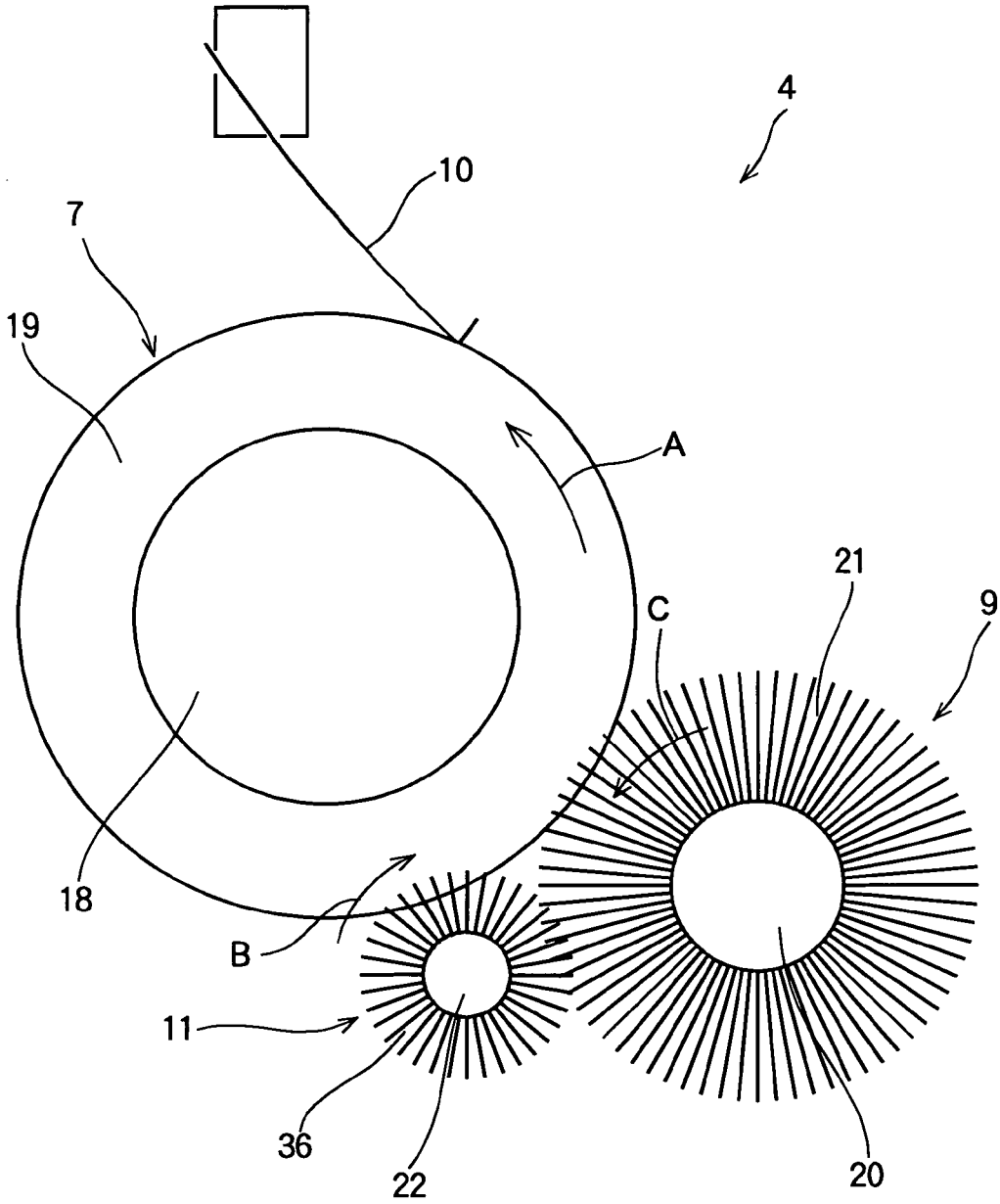
FIG. 6 is a schematic view showing a developing device of the image forming apparatus according to the second embodiment.

FIG. 5 shows the printing pattern (with which ghost may easily occur) used in the evaluation test. The printing pattern includes a white image area A of 0% duty, a solid image area B of 100% duty, and a halftone image area C of 50% duty. A distance "d" shown in FIG. 5 corresponds to a circumferential length of the developing roller 7. Here, a direction from the halftone image area C toward the white image area A and the solid image area B is referred to as upward, and its opposite direction is referred to as downward.

The pattern starts to be printed on the printing medium 12 from the areas A and B. That is, the white image area A (where the toner 8 is not consumed) and the area B (where the toner 8 is consumed) are first printed on the printing medium 12, and then the halftone image area C is printed on the printing medium 12.

Ghost was evaluated based on color-difference between two portions within a distance "d" from the upper end of the halftone image area C and respectively below the white image area A and the solid image area B. Measurement was performed using a "spectrophotometer 528" (manufactured by X-Rite Inc.) and "L*a*b" was determined, based on which the color difference ΔE was calculated. According to the National Bureau of Standards (NBS) of U.S.A., the color difference ΔE is classified as follows:

0.5 or less: trace
0.5-1.5: slight
1.5-3.0: noticeable
3.0-6.0: appreciable
6.0-12: much
12 or more: very much According to the above described classification, level of ghost (hereinafter, referred to as ghost level) was classified based on the color-difference ΔE as follows:

Level 5: $\Delta E \leq 0.5$
Level 4: $0.5 < \Delta E \leq 1.5$
Level 3: $1.5 < \Delta E \leq 3.0$
Level 2: $3.0 < \Delta E \leq 6.0$
Level 1: $6.0 < \Delta E \leq 12$ Here, when the color-differences ΔE is 0.5 or less, it is determined that there is no color difference (i.e., ghost is unnoticeable). When the color-differences ΔE is in a range from 0.5 to 1.5, it is determined that there is a slight and almost unnoticeable color difference (i.e., ghost is almost unnoticeable). Therefore, Levels 4 and 5 are defined as levels that provide satisfactory printing quality.

TABLE 1 shows evaluation results of ghost for the image forming apparatus 100 of the first embodiment and the image forming apparatus 100A of the comparison example.

TABLE 1

| IMAGE FORMING APPARATUS | GHOST LEVEL |
|---|---|
| IMAGE FORMING APPARATUS 100 OF FIRST EMBODIMENT | Level 5 |
| IMAGE FORMING APPARATUS 100A OF COMPARISON EXAMPLE | Level 3 |

As shown in TABLE 1, when the image forming apparatus 100A of comparison example is used, the ghost level is Level 3. In contrast, when the image forming apparatus 100 of the first embodiment is used, the ghost level is Level 5. Therefore, it is understood that the image forming apparatus 100 of the first embodiment provides satisfactory printing quality.

[Overlapping Amount of Recovery Roller and Supplying Roller]

Next, a description will be made of an evaluation test using the image forming apparatus 100 of the first embodiment while varying an overlapping amount D (FIG. 2) of the brush bristles 21 and 23 of the recovery roller 11 and the supplying roller 9. The overlapping amount D (FIG. 2) of the brush bristles 21 and 23 of the recovery roller 11 and the supplying roller 9 is measured by, for example, radii of the recovery roller 11 and the supplying roller 9 and a center-to-center distance between the recovery roller 11 and the supplying roller 9. The evaluation test was performed using the printing pattern shown in FIG. 5 while varying the overlapping amount D to 0 mm, 0.1 mm, 0.2 mm, 0.4 mm, 0.6 mm and 1.0 mm. Then, the ghost level was determined as described above. In this regard, the overlapping amount "0 mm" means that the recovery roller 11 and the supplying roller 9 do not contact each other.

Furthermore, for each overlapping amount, white images were continuously printed on 500 recording media (i.e., 500 pages), and then the printing pattern shown in FIG. 5 was printed. Subsequently, the ghost level was determined. TABLE 2 shows the evaluation results of the ghost level.

TABLE 2

| OVERLAPPING AMOUNT | GHOST LEVEL BEFORE CONTINUOUS PRINTING | GHOST LEVEL AFTER CONTINUOUS PRINTING |
|---|---|---|
| 0 | Level 5 | Level 3 |
| 0.1 mm | Level 5 | Level 5 |
| 0.2 mm | Level 5 | Level 5 |
| 0.4 mm | Level 5 | Level 5 |
| 0.6 mm | Level 5 | Level 5 |
| 1.0 mm | Level 5 | Level 5 |

Before the continuous printing, satisfactory results (i.e., Level 5) are obtained for all of the overlapping amounts. However, after the continuous printing of white images on 500 pages, noticeable ghost is found (i.e., Level 3) when the overlapping amount is 0 mm, i.e., when the recovery roller 11 and the supplying roller 9 do not contact each other. This is because, as the continuous printing of the white images proceeds, the toner 8 recovered by the recovery roller 11 (whose charging amount is large) is accumulated on the recovery roller 11, and a capacity with which the recovery roller 11 recovers the residual toner 8 using electrostatic force decreases.

In contrast, when the recovery roller 11 and the supplying roller 9 contact each other, satisfactory results (Level 5) are obtained for both before and after the continuous printing. This is because, in the contact portion between the recovery roller 11 and the supplying roller 9, the brush bristles 23 of the recovery roller 11 (whose circumferential speed is faster) bow, and then the brush bristles 23 are flipped at a termination point of the contact portion. With the flipping of the brush bristles 23, the toner 8 is easily released from the brush bristles 23.

If the overlapping amount D between the recovery roller 11 and the supplying roller 9 is too large, the recovery roller 11 and the supplying roller 9 are applied with large torque. Therefore, the overlapping amount D between the recovery roller 11 and the supplying roller 9 is preferably less than or equal to 1.0 mm.

[Fineness of Brush Bristels of Recovery Roller and Supplying Roller]

Fineness of the brush bristles 23 has an influence on an ability with which the recovery roller 11 recovers the toner 8. Further, the toner 8 is released from the brush bristles 23 of the recovery roller 11 when the brush bristles 23 contact the supplying roller 9 as described above. Therefore, the fineness of the brush bristles 23 has an influence on a releasability of the toner 8 from the recovery roller 11.

Here, the evaluation test was performed using the printing pattern shown in FIG. 5 while varying the fineness of the brush bristles 23 of the recovery roller 11 to 1, 2, 6, 8 and 10 decitex, and then the ghost level was determined as described above. In this regard, the fineness of the brush bristles 21 of the supplying roller was 6 decitex. The measurement of ghost level was performed before and after the continuous printing of white images on 500 pages as described above. TABLE 3 shows the evaluation results of the ghost level.

TABLE 3

| FINENESS OF BRUSH BRISTELS | GHOST LEVEL BEFORE CONTINUOUS PRINTING | GHOST LEVEL AFTER CONTINUOUS PRINTING |
|---|---|---|
| 1 Decitex | Level 4 | Level 4 |
| 2 Decitex | Level 5 | Level 5 |
| 6 Decitex | Level 5 | Level 5 |
| 8 Decitex | Level 5 | Level 4 |
| 10 Decitex | Level 5 | Level 4 |

As shown in TABLE 3, when the fineness of the brush bristles 23 of the recovery roller 11 is 1 decitex, the ghost level is Level 4, i.e., ghost on the printing medium is at almost unnoticeable level. When the fineness of the brush bristles 23 of the recovery roller 11 is greater than 6 decitex (which is the same as that of the supplying roller 9), the ghost level is Level 5 before the continuous printing of 500 pages, but is Level 4 after the continuous printing of 500 pages.

This is because, as the rigidity of the brush bristles 23 increases, the brush bristles 23 do not easily bow even when the brush bristles 23 contact the supplying roller 9, so that the toner 8 is less likely to be released from the brush bristles 23. For this reason, in order to maintain a printing quality for a long time, the fineness of the brush bristles 23 of the recovery roller is preferably less than the fineness of the brush bristles 21 of the supplying roller 9.

As described above, according to the first embodiment of the present invention, the developing device 4 includes the supplying roller 9 for supplying the toner 8 to the developing roller 7, and also includes the recovery roller 11 for recovering the residual toner 8 from the developing roller 7. The recovery roller 11 is constituted by the brush roller.

Since the recovery roller 11 is constituted by the brush roller, it becomes possible to reduce damage to the toner 8 when the recovery roller 11 recovers the toner 8 from the developing roller 7. Further, it is not necessary to generate electric field between the recovery roller 11 and the developing roller 7 in a direction in which the toner 8 moves from the recovery roller 11 to the developing roller 7, and therefore efficiency in recovering the residual toner 8 from the developing roller 7 can be enhanced.

Further, since the supplying roller 9 and the recovery roller 11 are provided so as to contact each other, the residual toner 8 recovered by the recovery roller 11 is released therefrom by contacting the supplying roller 9. Therefore, the capacity with which the recovery roller 11 recovers the residual toner 8 is maintained, and efficiency in recovering the residual toner 8 from the developing roller 7 can be further enhanced. Furthermore, since the supplying roller 9 is constituted by the brush roller, the residual toner 8 is easily released from the recovery roller 11.

Moreover, the developing roller 7 and the recovery roller 11 are applied with voltages so that the charged toner 8 is applied with an electrostatic force in a direction from the developing roller 7 toward the recovery roller 11.

That is, the recovery roller 11 can recover the residual toner 8 from the developing roller 7 using the electrostatic force. Thus, the damage to the toner 8 can be further reduced, and the efficiency in recovering the residual toner 8 from the developing roller 7 can be further enhanced.

Further, since the recovery roller 11 and the developing roller 7 rotate in mutually opposite directions, the circumferential surfaces of the recovery roller 11 and the developing roller 7 move in mutually same direction at the contact portion therebetween. Further, the recovery roller 11 rotates at a faster circumferential speed than the developing roller 7. Therefore, the efficiency in recovering the residual toner 8 from the developing roller 7 by the recovery roller 11 can be further enhanced.

Furthermore, the circumferential speed of the recovery roller 11 is faster than the circumferential speed of the supplying roller 9. Therefore, the supplying roller 9 flips the toner 8 (adhering to the brush bristles 23 of the recovery roller 11), and the toner 8 can be easily released from the recovery roller 11.

Additionally, the fineness of the brush bristles 23 of the recovery roller 11 is lower than the fineness of the brush bristles 21 of the supplying roller 9, and therefore it becomes possible to maintain a quality of the image formed on the printing medium for a long time period.

Second Embodiment

Next, the second embodiment of the present invention will be described. An image forming apparatus 100 of the second embodiment is different from the image forming apparatus 100 of the first embodiment in material of brush bristles 36 of the recovery roller 11.

In the above described first embodiment, the brush bristles 23 of the recovery roller 11 are made of nylon. In contrast, in the second embodiment, the brush bristles of the recovery roller 11 are made of Teflon (Trademark), i.e., polytetrafluoroethylene (PTFE). PTFE is a material positioned on the negative side in triboelectric series with respect to polyester (i.e., the binder resin of the toner 8).

[Hygrothermal Conditions]

Here, a description will be made of an influence of temperature and humidity (hygrothermal conditions) in the image forming apparatus 100 on a quality of an image formed on the printing medium.

In the developing device 4, the toner 8 is charged mainly by friction. Frictional charging (i.e., triboelectric charging) is likely to occur in a low-temperature and low-humidity condition, but is less likely to occur in a high-temperature and high-humidity condition. Further, a charging amount of the toner 8 tends to be maintained in the low-temperature and low-humidity condition. In other words, in the low-temperature and low-humidity condition, the charging amount of the toner 8 tends to be large, and therefore smear may occur on the printing medium.

In the image forming apparatus 100A (FIG. 4) having no recovery roller 11, the toner 8 is charged by friction with the supply-and-recovery roller 35, the toner layer regulating blade 10 and the like. The toner 8 which has not been used for development is carried back into the developing device 4A. In the developing device 4A, the toner 8 is further charged by friction with the supply-and-recovery roller 35, and then is supplied to the developing roller 7. For this reason, if a low density printing (in which less toner is consumed) is continuously performed under the low-temperature and low-humidity condition, the toner 8 on the developing roller 7 is subjected to repeated charging. Therefore, smear is likely to occur due to excessive charging of the toner 8.

In contrast, in the image forming apparatus 100 (FIG. 1) having the recovery roller 11 according to the first embodiment, the toner 8 is charged by friction with the supplying roller 9, the toner layer regulating blade 10 and the like. The toner 8 which has not been used for development is carried back into the developing device 4. In the developing device 4, the toner 8 is recovered by the recovery roller 11 by means of electrostatic force, and then the toner 8 is released from the recovery roller 11 by the supplying roller 9. Therefore, even if a low density printing is continuously performed under the low-temperature and low-humidity condition, excessive charging of the toner 8 is not likely to occur, and therefore smear is not likely to occur.

However, in the image forming apparatus 100 (FIG. 1) having the recovery roller 11 according to the first embodiment, the brush bristles 21 and 23 of the supplying roller 9 and the recovery roller 11 are both made of nylon. Nylon is a material positioned on the positive side in triboelectric series with respect to polyester (i.e., binder resin of the toner 8). That is, Nylon has ability to charge the toner 8 (having negative chargeability) containing polyester as the binder resin by friction. Therefore, there is a possibility that the charging amount of the toner 8 in the developing device 4 may gradually increase. As a result, there is a possibility that density unevenness may occur, for example, when a halftone image is printed after continuous printing of white image of 0% duty.

[Evaluation Test]

An evaluation test was performed using the image forming apparatus 100 while varying the material of the brush bristles of the recovery roller 11 and the supplying roller 9 to nylon, polyester and PTFE. The evaluation test was performed as described below.

Under the high-temperature and high-humidity condition, printing of white image (of 0% duty) was performed, and fog on a non-image-portion was evaluated.

Further, under the low-temperature and low-humidity condition, printing of halftone image of 25% duty was performed before and after continuous printing of white images on 2000 pages. Then, a color difference between the halftone images of 25% duty printed before and after the continuous printing of the white images was measured.

Fog was evaluated as described below. The image forming apparatus 100 was stopped during the printing of white image of 0% duty. Then, an adhesion tape "Scotch Mending Tape" (manufactured by Sumitomo 3M Ltd.) was attached to the surface of the photosensitive drum 1 after development of the latent image and before transferring of the developed toner image. Then, the adhesion tape (to which the toner adheres) was attached to a white paper. For comparison, another adhesion tape which was not attached to the photosensitive drum 1 (referred to as a comparison tape) was also attached to the same white paper. Then, a color difference ΔE between two adhesion tapes is measured using a spectrophotometric colorimeter "CM-2600d" (manufactured by Konica-Minolta Ltd.). As the color difference ΔE is small, it indicated that the fog is small. As described in the first embodiment, when the color-difference ΔE is 0.5 or less, it is determined that there is no color difference (i.e., no fog). When the color-difference ΔE is in a range from 0.5 to 1.5, it is determined that there is a slight and almost unnoticeable color difference (i.e., a slight and almost unnoticeable fog). In contrast, when the color-difference ΔE is 1.5 or more, it is determined that there is a noticeable color difference (i.e., a noticeable fog).

In this method, although the color difference is evaluated based on the toner collected from the photosensitive drum 1 using the adhesion tape, not all of the toner on the photosensitive drum 1 is transferred to the printing medium. A transferring rate of fog-causing toner (i.e., excessively-charged toner) varies based on the printing medium (printing sheet). However, when the color difference ΔE measured using this method is 1.0 or less, it is ensured that the color-difference ΔE measured on the printing medium is also 1.0 or less and that satisfactory printing quality is obtained.

A change in density of the halftone image was evaluated according to the color difference ΔE calculated based on L*a*b measured using the "spectrophotometer 528" (manufactured by X-Rite Inc.) as described in the first embodiment. The results were classified in Levels 1 to 5 as described in the first embodiment, and Levels 4 and 5 were defined as levels that provide satisfactory printing quality. TABLE 4 shows the evaluation results of fog and change in density of halftone image with respect to the material of the brush bristles of the supplying roller 9 and the recovery roller 11.

TABLE 4

| MATERIAL | | EVALUATION RESULT | |
|---|---|---|---|
| SUPPLYING ROLLER | RECOVERY ROLLER | FOG LEVEL (H/H) | CHANGE IN DENSITY (L/L) |
| NYLON | NYLON | OK | LEVEL 3 |
| NYLON | POLYESTER | OK | LEVEL 4 |
| NYLON | PTFE | OK | LEVEL 5 |
| POLYESTER | NYLON | NG | LEVEL 4 |
| POLYESTER | POLYESTER | NG | LEVEL 4 |
| POLYESTER | PTFE | NG | LEVEL 5 |
| PTFE | NYLON | NG | LEVEL 5 |
| PTFE | POLYESTER | NG | LEVEL 5 |
| PTFE | PTFE | NG | LEVEL 5 |

Based on TABLE 4, when the brush bristles 21 of the supplying roller 9 are formed of nylon which is a material that charges the toner 8 to a normal polarity, fog is suppressed to a satisfactory level under the high-temperature and high-humidity condition.

Further, when the brush bristles 36 of the recovery roller 11 are formed of PTFE which is a material that charges the toner 8 to a reverse polarity, the change in density of the halftone image can be suppressed to a satisfactory level even when the halftone image is printed after continuous printing of white images under the low-temperature and low-humidity condition.

As described above, according to the second embodiment, the brush bristles 21 of the supplying roller are formed of a material positioned in triboelectric series so as to charge the toner 8 to a normal polarity, and the brush bristles 36 of the recovery roller 11 are formed of a material positioned in triboelectric series that charges the toner 8 to a reverse polarity. With such a configuration, excellent image with little fog and little change in density can be formed.

In the above described embodiments, descriptions have been made of examples where the developing device is applied to an electrophotographic color printer of a nonmagnetic single component contact type. However, the present invention is not limited to such examples. The developing device of the present invention is applicable to other image forming apparatus using electrophotography such as a monochrome printer, copier or the like.

While the preferred embodiments of the present invention have been illustrated in detail, it should be apparent that modifications and improvements may be made to the invention without departing from the spirit and scope of the invention as described in the following claims.

What is claimed is:

1. A developing device comprising:

a developer bearing body provided so as to face a latent image bearing body, said developer bearing body having a developer thereupon and rotating to supply said developer to said latent image bearing body;

a developer supplying member provided so as to contact said developer bearing body, said developer supplying member rotating to supply said developer to said developer bearing body; and a developer recovery member provided so as to contact a surface of said developer bearing body that moves from a position facing said latent image bearing body to a position in contact with said developer supplying member by a rotation of said developer bearing body, said developer recovery member rotating to recover said developer from said developer bearing body, wherein said developer recovery member is constituted by a brush roller, wherein said developer supplying member and said developer recovery member are provided so as to contact each other.

2. The developing device according to claim 1, wherein said developer supplying member is constituted by another brush roller.

3. The developing device according to claim 2, wherein fineness of brush bristles of said developer recovering member is smaller than fineness of brush bristles of said developer supplying member.

4. The developing device according to claim 3, wherein fineness of brush bristles of said developer recovery member is in a range from 2 decitex to 6 decitex.

5. The developing device according to claim 2, wherein said developer supplying member and said developer recovery member overlap with each other with an overlapping amount in a range from 0.1 mm to 1.0 mm.

6. The developing device according to claim 1, wherein said developing recovery member rotates in a direction opposite to a direction that said developer bearing body rotates in.

7. An image forming apparatus comprising said developing device according to claim 1.

8. A developing device comprising:

a developer bearing body provided so as to face a latent image bearing body, said developer bearing body having a developer thereupon and rotating to supply said developer to said latent image bearing body;

a developer supplying member provided so as to contact said developer bearing body, said developer supplying member rotating to supply said developer to said developer bearing body; and a developer recovery member provided so as to contact a surface of said developer bearing body that moves from a position facing said latent image bearing body to a position in contact with said developer supplying member by a rotation of said developer bearing body, said developer recovery member rotating to recover said developer from said developer bearing body, wherein said developer recovery member is constituted by a brush roller, wherein said developing recovery member rotates at a circumferential speed faster than a circumferential speed of said developer supplying member.

9. A developing device comprising:

a developer bearing body provided so as to face a latent image bearing body, said developer bearing body having a developer thereupon and rotating to supply said developer to said latent image bearing body;

a developer supplying member provided so as to contact said developer bearing body, said developer supplying member rotating to supply said developer to said developer bearing body; and a developer recovery member provided so as to contact a surface of said developer bearing body that moves from a position facing said latent image bearing body to a position in contact with said developer supplying member by a rotation of said developer bearing body, said developer recovery member rotating to recover said developer from said developer bearing body, wherein said developer recovery member is constituted by a brush roller, wherein said developing recovery member rotates at a circumferential speed faster than a circumferential speed of said developer bearing body.

10. A developing device comprising:

a developer bearing body provided so as to face a latent image bearing body, said developer bearing body having a developer thereupon and rotating to supply said developer to said latent image bearing body;

a developer supplying member provided so as to contact said developer bearing body, said developer supplying member rotating to supply said developer to said developer bearing body; and a developer recovery member provided so as to contact a surface of said developer bearing body that moves from a position facing said latent image bearing body to a position in contact with said developer supplying member by a rotation of said developer bearing body, said developer recovery member rotating to recover said developer from said developer bearing body, wherein said developer recovery member is constituted by a brush roller, wherein said developer recovery member is applied with a higher voltage than that applied to said developer bearing body, in the case where said developer has a negative chargeability, and wherein said developer recovery member is applied with a lower voltage than that applied to said developer bearing body, in the case where said developer has a positive chargeability.

11. A developing device comprising:

a developer bearing body provided so as to face a latent image bearing body, said developer bearing body having a developer thereupon and rotating to supply said developer to said latent image bearing body;

a developer supplying member provided so as to contact said developer bearing body, said developer supplying member rotating to supply said developer to said developer bearing body; and a developer recovery member provided so as to contact a surface of said developer bearing body that moves from a position facing said latent image bearing body to a position in contact with said developer supplying member by a rotation of said developer bearing body, said developer recovery member rotating to recover said developer from said developer bearing body, wherein said developer recovery member is constituted by a brush roller, wherein said developer recovery member is formed of a material positioned in triboelectric series so as to charge said developer to a reverse polarity, and said developer supplying member is formed of a material positioned in triboelectric series so as to charge said developer to a normal polarity.

12. The developing device according to claim 11, wherein said material of said developer recovery member is polytetrafluoroethylene, and wherein said material of said developer supplying member is nylon.

13. A developing device comprising:

a developer bearing body provided so as to face a latent image bearing body, said developer bearing body having a developer thereupon and rotating to supply said developer to said latent image bearing body;

a developer supplying member provided so as to contact said developer bearing body, said developer supplying member rotating to supply said developer to said developer bearing body; and a developer recovery member provided so as to contact a surface of said developer bearing body that moves from a position facing said latent image bearing body to a position in contact with said developer supplying member by a rotation of said developer bearing body, said developer recovery member rotating to recover said developer from said developer bearing body, wherein said developer supplying member and said developer recovery member are provided so as to contact each other.

14. The developing device according to claim 13, wherein said developer supplying member rotates in a direction that is the same as a direction that said developer bearing body rotates in, and wherein said developer recovery member rotates in a direction that is opposite than the direction that said developer bearing body rotates in.

15. The developing device according to claim 14, wherein said developer recovery member is constituted by a brush roller.

16. The developing device according to claim 15, wherein said developer supplying member is constituted by another brush roller.

17. The developing device according to claim 16, wherein fineness of brush bristles of said developer recovering member is smaller than fineness of brush bristles of said developer supplying member.

18. The developing device according to claim 17, wherein fineness of brush bristles of said developer recovery member is in a range from 2 decitex to 6 decitex.

19. The developing device according to claim 16, wherein said developer supplying member and said developer recovery member overlap with each other with an overlapping amount in a range from 0.1 mm to 1.0 mm.

20. The developing device according to claim 13, wherein said developing recovery member rotates at a circumferential speed faster than a circumferential speed of said developer supplying member.

21. The developing device according to claim 13, wherein said developing recovery member rotates in a direction opposite to a direction that said developer bearing body rotates in.

22. The developing device according to claim 13, wherein said developing recovery member rotates at a circumferential speed faster than a circumferential speed of said developer bearing body.

23. The developing device according to claim 13, wherein said developer recovery member is applied with a higher voltage than that applied to said developer bearing body, in the case where said developer has a negative chargeability, and wherein said developer recovery member is applied with a lower voltage than that applied to said developer bearing body, in the case where said developer has a positive chargeability.

24. An image forming apparatus comprising said developing device according to claim 13.

25. The developing device according to claim 13, wherein said developer recovery member is formed of a material positioned in triboelectric series so as to charge said developer to a reverse polarity, and said developer supplying member is formed of a material positioned in triboelectric series so as to charge said developer to a normal polarity.

26. The developing device according to claim 25, wherein said material of the developer recovery member is polytetrafluoroethylene, and wherein said material of said developer supplying member is nylon.

* * * * *